United States Patent [19]

Free

[11] Patent Number: 4,784,414

[45] Date of Patent: Nov. 15, 1988

[54] LATCH MECHANISM

[75] Inventor: James J. Free, Elkhart, Ind.

[73] Assignee: Coachmen Industries, Inc., Middlebury, Ind.

[21] Appl. No.: 90,596

[22] Filed: Aug. 28, 1987

[51] Int. Cl.[4] ..... E05C 9/08

[52] U.S. Cl. ..... 292/52; 292/336.3

[58] Field of Search ..... 292/26, 29, 52, 118, 292/126, 226, 217, 218, DIG. 5, DIG. 31, 12, 128, 336.3

[56] References Cited

U.S. PATENT DOCUMENTS

| | | | |
|---|---|---|---|
| 1,597,079 | 8/1926 | Kugley | 292/218 |
| 1,831,494 | 11/1931 | Hynes et al. | 292/118 X |
| 1,926,102 | 9/1933 | Keeler | 292/120 |
| 3,596,952 | 8/1971 | Hinkle | 292/29 X |
| 4,134,281 | 1/1979 | Pelcin | 292/DIG. 31 X |
| 4,681,357 | 7/1987 | Vemura et al. | 292/DIG. 31 X |

*Primary Examiner*—Richard E. Moore

*Attorney, Agent, or Firm*—Thomas J. Dodd

[57] ABSTRACT

A latch mechanism for a vehicle closure member. The latch includes a horizontal torsion rod activated by vertically lifting up on a handle operatively connected to the rod to lock and unlock the closure member. Biasing springs urge the handle and rod towards their closed or locked positions.

3 Claims, 4 Drawing Sheets

LATCH MECHANISM

FIELD OF THE INVENTION

This invention relates to a latch mechanism and will have application to latch mechanisms for truck caps, recreational vehicles, and other similar uses.

BACKGROUND OF THE INVENTION

Previously, the large majority of the truck caps and recreational vehicles included securement latches which were opened and locked by a "T" handle and rod (or flexible chain) arrangement. The handle was rotated generally along an axis perpendicular to the axis of the latching rod or chain. Various disadvantages are inherent in such devices, namely the need for an energy transfer part which adds to the cost of the latch, high energy amounts required to twist then lift the door or other closure member, and security factors.

SUMMARY OF THE INVENTION

The latch mechanism of this invention includes a substantially flush mount handle which is lifted up to disengage the peripherally located latch hooks to open the closure member. Since the motion of disengagement is identical to the opening movement of the closure member, less energy is expended than with "T" handle closures. Also, the handle itself is the hinge actuator and rotates along the same axis as the latch rod, which eliminates the need for an energy transfer part.

Accordingly, it is an object of this invention to provide for a latch mechanism which is more efficient and economical than previous latches.

Another object of this invention is to provide for a latch mechanism which may be adapted to one of several end uses.

Another object of this invention is to provide for a latch mechanism which is easily and safely secured.

Other objects of this invention will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable other skilled in the art to utilize the invention.

Figure 5:
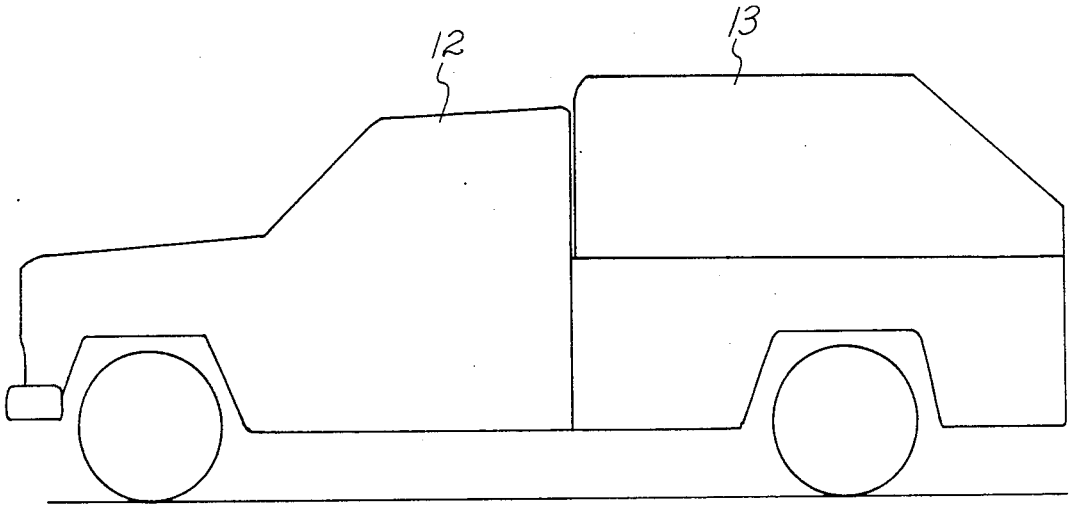
FIG. 5 is an elevational view of a pick up truck showing the closure member in a closed position.

Referring now to the drawings, reference numeral 10 designates generally the latch mechanism of this invention. Latch mechanism 10 is shown in use on a closure member 50 of a pick up truck 12 (FIG. 5) but may be used to secure many different types of closures, such as hoods, vehicle roofs, suit cases, trunks, boat doors and coverings, cabinets, tool boxes and other types of compartments which have a latched closure member.

Figure 1:
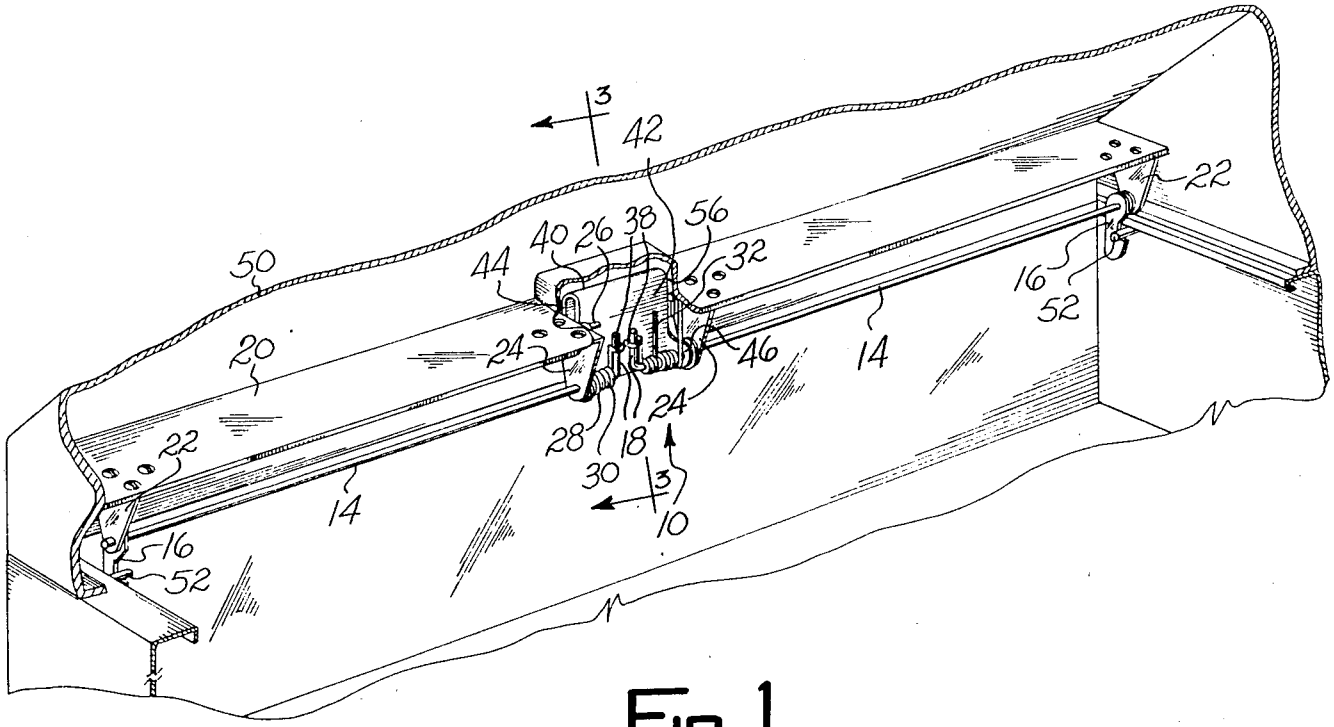
FIG. 1 is a fragmentary perspective view of the latch mechanism in the closed position shown in use on a closure member.
Figure 2:
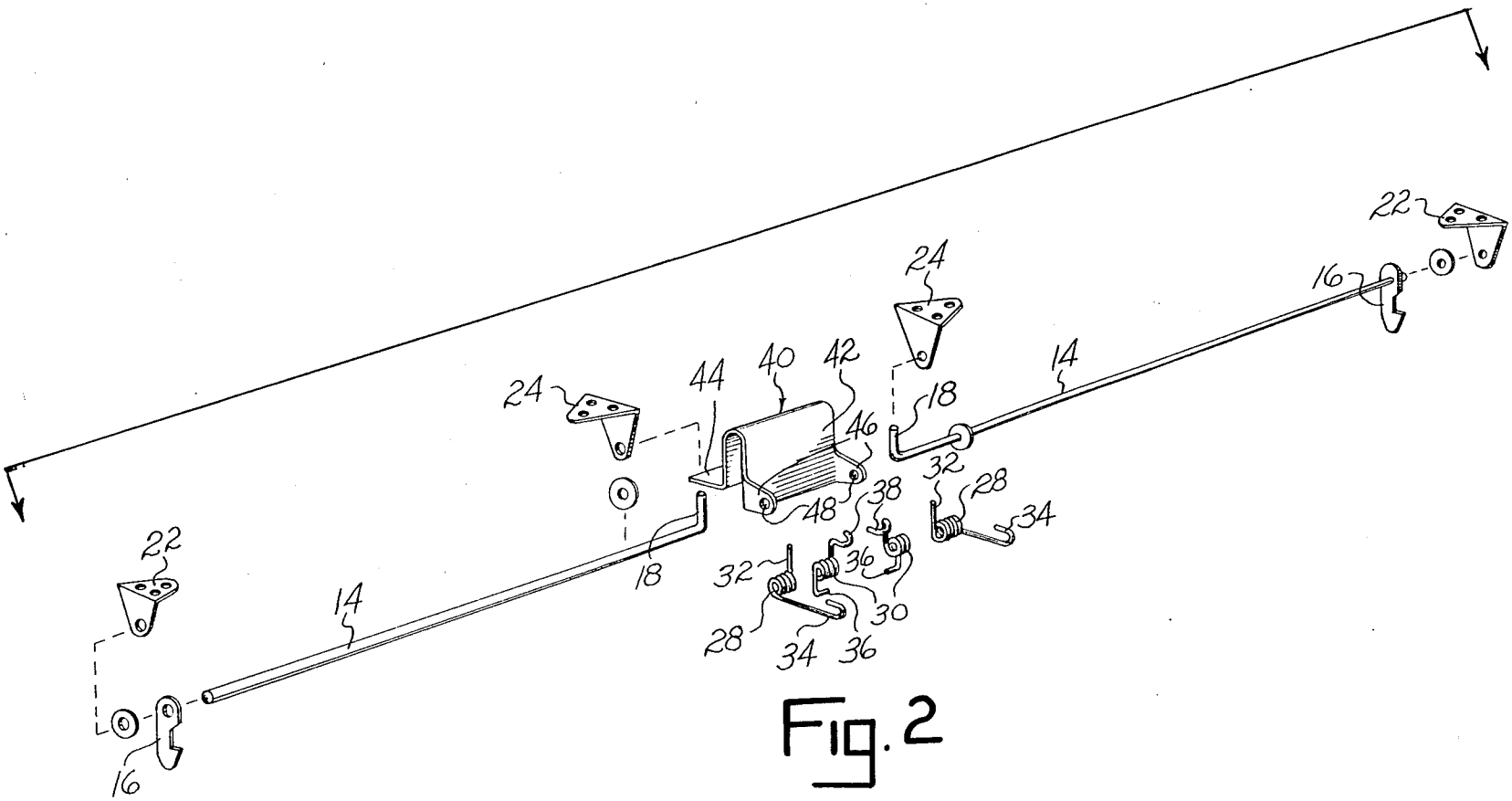
FIG. 2 is a perspective view of the latch mechanism with the components thereof shown in separated form.

As shown in FIGS. 1–2, latch mechanism 10 includes one or more latch rods 14 (two shown) which have a latch hook 16 attached to the terminal end thereof. In the embodiment shown in the drawings, two latch rods 14 are shown but it is understood that a single latch rod having a similar shape as the combined rods may be used with equivalent results. Each latch rod 14 is of the general elongated shape shown with a bent portion 18. Each latch rod 14 is operatively secured to closure member frame 20 through a plurality of mounting brackets 22 and 24 (Two shown for each rod 14). Each mounting bracket 24 may include a projection pin 26 as shown.

Positioned between each bracket 24 and rod bent end position 18 are springs 28, 30. Each spring 28 is a helical spring which includes a terminal projecting end part 32 and a terminal projecting end 34 as shown in FIG. 2. Each spring 30 has a terminal L-shaped end 36 and a terminal hook part 38 as also shown in FIG. 2.

Latch mechanism 10 also includes a handle 40 of the general shape shown in FIG. 2. Handle 40 is of one piece construction and has a base plate 42 and a return bent lifting flange portion 44. A pair of ears 46 each including a bore 48 project from opposite sides of base plate 42. In operation, each rod bend end 18 is fitted through an ear bore 48 and springs 28, 30 positioned between ear 46 and the rod bent end. The terminal ends 32, 36 of the respective springs 28, 30 and rod bent end 18 abuts against handle base plate 42 with the terminal projecting end 34 of each spring 28 fitted about bracket pins 26 to urge the rod bent end against the handle base plate, to hold handle 40 in a normally closed position as seen in FIGS. 1 and 3.

Figure 4:
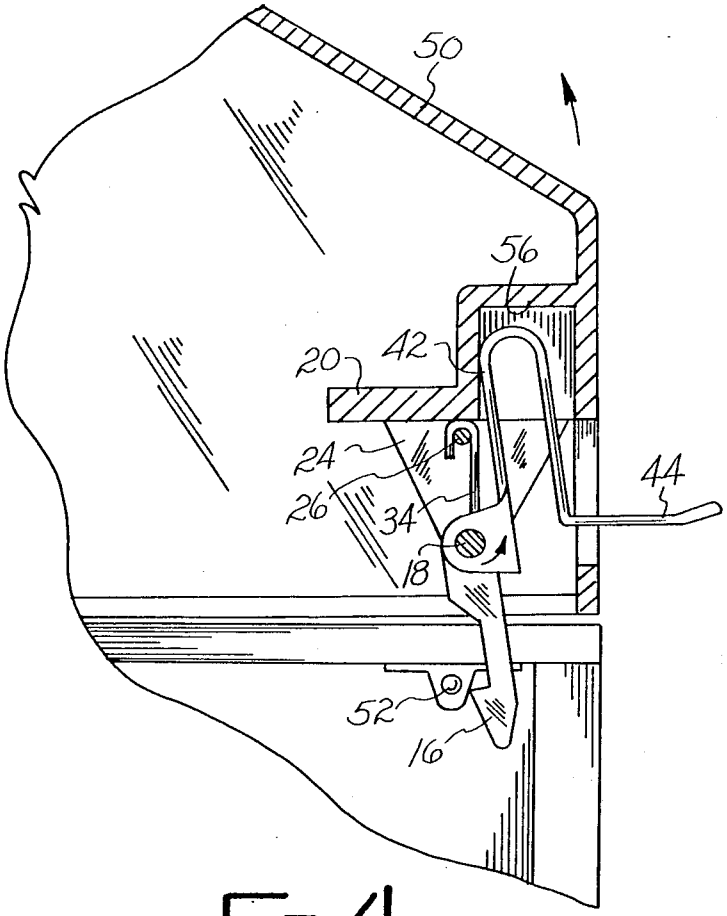
FIG. 4 is a fragmentary cross-sectional view similar to FIG. 3, showing the latch in an open position.
Figure 3:
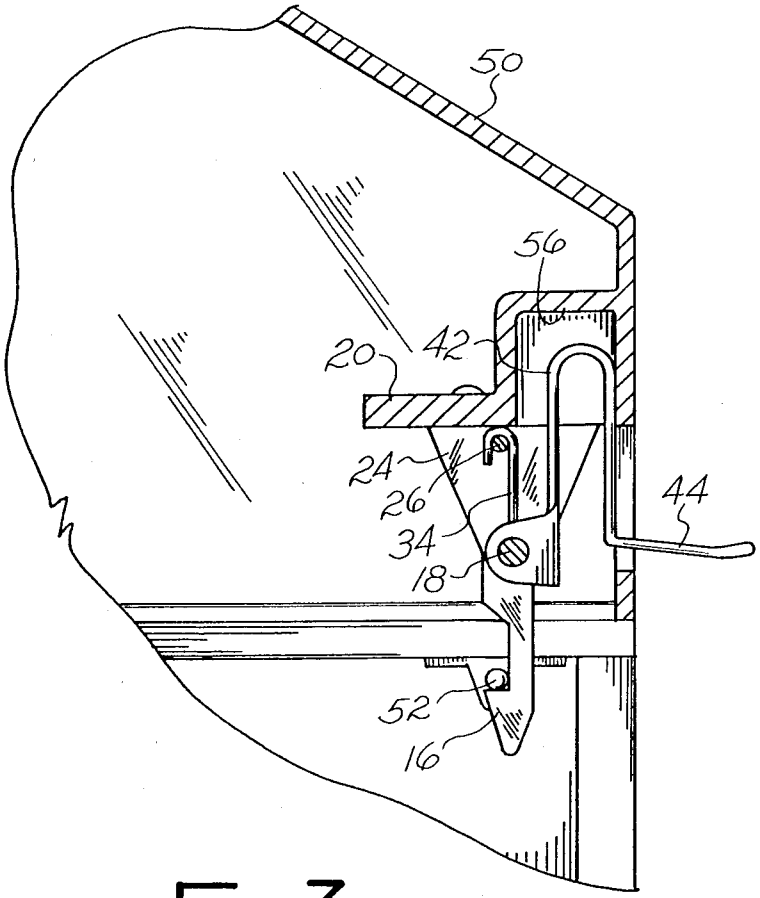
FIG. 3 is a fragmentary cross-sectional view taken along line 3—3 of FIG. 1.
Figure 6:
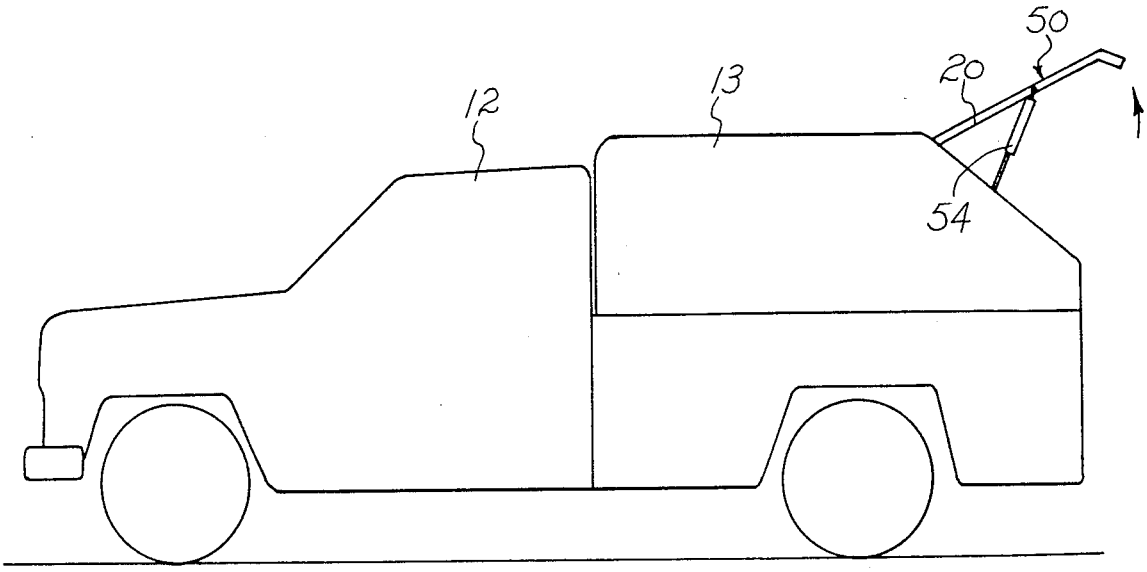
FIG. 6 is an elevational view similar to FIG. 5 showing the closure member opened.

FIGS. 1 and 3 illustrate the latch mechanism 10 in a closed or latched position. To open closure member 50 of truck cap 13, a user grasps handle lifting flange 46 (which is fitted in a restrictive channel part 56 of closure frame 20 and extends outwardly of the closure member) and lifts upwardly. This lifting action causes base plate 42 to rotate and through rod bent ends 18 effects corresponding rotation of rods 14 and latch hooks 16 until the hooks clear their respective latch pins 52 (FIG. 4) allowing the closure member 50 to be opened (FIG. 6). One or more air cylinders 54 may be employed to provide smooth motion of closure member 50 during opening and closing and such cylinders are well known in the art. A locking device (not shown) may be used to inhibit rotation of handle 40 to lock closure member 50 in the closed position of FIG. 5.

It is to be understood that the above description does not limit the invention to the above given details, and that it may be modified within the scope of the following claims.

I claim:

1. In combination, a latch mechanism and a closure member, said latch mechanism including a torsion member having latching means operatively connected thereto for locking said closure member in a closed position, a handle operatively connected to said torsion member wherein pivoting movement of said handle effects corresponding rotation of said latching means into an open position, first biasing means associated with said torsion member and said handle for urging said latching means and closure member toward said closed position, said torsion member including first and second rods each having a bent end portion abutting said handle, said handle including a base plate having spaced opposed ears, each rod extending through a said handle ear, each rod further including an end portion opposite said bent end portion terminating in a hook member, said hook member constituting means for engaging a latch pin to lock said closure member in said closed position.

2. The combination of claim 1 wherein said handle member is of one piece construction and includes a base plate and a return bent flange portion, said biasing means including a spring connected to said rod and biasing against said handle base plate to urge the handle into its closed position.

3. The combination of claim 1 and further including a second biasing means connected to each rod, said second biasing means for urging said rod bent end portions into abutment with said handle base plate.

* * * * *